US006955416B2

(12) United States Patent
Shimosako

(10) Patent No.: US 6,955,416 B2
(45) Date of Patent: Oct. 18, 2005

(54) INK-JET HEAD, ITS DRIVING METHOD, AND INK-JET RECORDING APPARATUS

(75) Inventor: Yoshiyuki Shimosako, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 112 days.

(21) Appl. No.: 10/461,245

(22) Filed: Jun. 13, 2003

(65) Prior Publication Data

US 2003/0231225 A1 Dec. 18, 2003

(30) Foreign Application Priority Data

Jun. 14, 2002 (JP) ..... 2002-174344
Sep. 25, 2002 (JP) ..... 2002-279921

(51) Int. Cl.[7] ..... B41J 2/135
(52) U.S. Cl. ..... 347/46
(58) Field of Search ..... 347/10, 11, 45–47, 347/54, 68

(56) References Cited

U.S. PATENT DOCUMENTS 4,751,530 A * 6/1988 Elrod et al. ..... 347/46
5,063,396 A 11/1991 Shiokawa et al. ..... 347/46
5,087,931 A * 2/1992 Rawson ..... 347/46
5,179,391 A 1/1993 Miyazaki ..... 347/176
5,339,101 A * 8/1994 Rawson et al. ..... 347/46
6,154,235 A * 11/2000 Fukumoto et al. ..... 347/46
6,283,580 B1 * 9/2001 Roy et al. ..... 347/46

FOREIGN PATENT DOCUMENTS

JP 04-294146 10/1992

* cited by examiner

*Primary Examiner*—Stephen Meier
*Assistant Examiner*—An H. Do
(74) *Attorney, Agent, or Firm*—Fitzpatrick, Cella, Harper & Scinto

(57) ABSTRACT

An ink-jet head jets ink by applying energy of surface acoustic waves to the ink for recording on a recording medium. The ink-jet head includes a surface acoustic wave propagation element that propagates surface acoustic waves, a plurality of surface acoustic wave generation devices disposed on the surface acoustic wave propagation element, a plurality of ink ejection sections that are disposed in the surface acoustic wave propagation element and disposed alternately with the plurality of surface acoustic wave generation devices along a single line, a plurality of surface acoustic wave amplification devices located between the surface acoustic wave generation devices and the ink ejection sections on the single line, and an ink supply unit that supplies ink to the ink ejection sections.

10 Claims, 14 Drawing Sheets

INK-JET HEAD, ITS DRIVING METHOD, AND INK-JET RECORDING APPARATUS

BACKGROUND OF THE INVENTION

1. Field of the Invention

The present invention relates to ink-jet heads, methods for driving ink-jet heads, and ink-jet recording apparatuses, in which ink is jetted by applying energy of surface acoustic waves to the ink.

2. Related Background Art

In recent years, research and study have been conducted on nozzleless ink-jet heads utilizing the streaming phenomenon of surface acoustic waves (hereafter also referred to as "SAWs"). A SAW is an elastic wave propagating near the free boundary of a solid and rapidly decaying with depth. The streaming phenomenon of a SAW is a phenomenon that, when a surface acoustic wave that locally propagates in a solid surface is emitted into liquid that is in contact with the solid surface, vibration energy of the surface acoustic wave is propagated into the liquid, and this energy causes minute particles of the liquid to be jetted. An ink-jet head that utilizes the SAW streaming phenomenon can effectively transfer the energy of a surface acoustic wave that is locally induced in the solid surface, and has a substantially greater advantage in view of the energy efficiency compared to other devices that use, for example, bulk vibrations of a piezo element.

However, in the conventional devices, although surface acoustic waves are induced in two directions, only the surface acoustic wave in one direction is used for jetting ink, and the surface acoustic wave in the other direction is treated as being unnecessary and attenuated. For this reason, in view of ink-jetting action, a half of the energy that is converted into the surface acoustic waves is wasted. In addition, a portion of the surface acoustic wave that is unnecessary for jetting ink may reflect on end surfaces of the device and interfere with the part of the surface acoustic wave that is used for jetting ink to thereby disturb the ink-jetting characteristics.

Also, among various research that has been conducted on liquid jetting heads that utilize the SAW streaming phenomenon, technologies concerning the integration of liquid jetting heads are very important in the application and development of this phenomenon to a variety of industrial fields. In one of the head integration technologies, an ink-jet head is provided with a comb-shaped electrode and a plurality of liquid ejection paths, wherein switching between ejection and non-ejection at each of the liquid ejection paths is realized based on whether or not liquid is supplied to each of the liquid ejection paths. However, when piezo elements are employed to conduct switching of the liquid supply to the corresponding liquid ejection paths, there is a limit in improving levels of the integration due to its structural limitation.

SUMMARY OF THE INVENTION

An embodiment of the present invention relates to an ink-jet head that jets ink by applying energy of surface acoustic waves to the ink for recording on a recording medium. The ink-jet head is equipped with a surface acoustic wave propagation element that propagates surface acoustic waves, a plurality of surface acoustic wave generation devices disposed on the surface acoustic wave propagation element, ink ejection sections that are disposed in the surface acoustic wave propagation element and disposed alternately with the plurality of surface acoustic wave generation devices along a single line, surface acoustic wave amplification devices located between the surface acoustic wave generation devices and the ink ejection sections on the single line, and an ink supply unit that supplies ink to the ink ejection sections. In one aspect, the plurality of surface acoustic wave generation devices are disposed such that all surface acoustic waves induced propagate along the single line.

Another embodiment of the present invention relates to a method for driving the ink-jet head described above, wherein each of the surface acoustic wave generation devices is driven such that an amplitude of the surface acoustic wave that is generated by each one of the surface acoustic wave generation devices and reaches one of the ink ejection sections nearest to each respective surface acoustic wave generation device is smaller than a threshold value of an amplitude for jetting ink from the each one of the ink ejection sections.

In accordance with one embodiment of the present invention, an ink-jet recording apparatus is equipped with the ink-jet head, and a voltage application device that applies a voltage independently to each of the plurality of surface acoustic wave generation devices of the ink-jet head, wherein the method for driving the ink-jet head described above is employed for recording.

Further, in accordance with an embodiment of the present invention, a liquid ejection head includes a liquid ejection section having a liquid ejection outlet and a liquid chamber connected to the liquid ejection outlet, a surface acoustic wave generation device that generates surface acoustic waves as energy to eject liquid from the liquid ejection section, a surface acoustic wave propagation element that propagates surface acoustic waves generated by the surface acoustic wave generation device to the liquid ejection section, and an amplification device that amplifies surface acoustic waves that propagate through the surface acoustic wave propagation element from the surface acoustic wave generation device toward the liquid ejection section.

Also, another embodiment of the present invention relates to a method for driving the liquid ejection head described above. The method includes the steps of driving the surface acoustic wave generation device such that an amplitude of a surface acoustic wave that reaches any of the liquid ejection sections is smaller than a threshold value of an amplitude that is required for ejecting liquid, and operating the amplification device to amplify the surface acoustic waves to have an amplitude that is equal to or greater than the threshold value required for ejecting the liquid from the liquid ejection outlet.

Furthermore, in accordance with an embodiment of the present invention, a liquid ejection apparatus includes the liquid ejection head described above, a driving device that provides a driving signal to the surface acoustic wave generation device, and a driving device that provides a driving signal according to the method for driving the liquid ejection head.

In accordance with an embodiment of the present invention, a liquid ejection head comprises: a surface acoustic wave propagation element that propagates surface acoustic waves; at least one surface acoustic wave generation device on the surface acoustic wave propagation element for generating a surface acoustic wave; at least one liquid ejection section provided in the surface acoustic wave propagation element; at least one surface acoustic wave amplification device between the at least one surface acoustic wave generation device and the at least one liquid ejection section for amplifying the surface acoustic wave generated by the at least one surface acoustic wave generation device; and a liquid supply unit that supplies liquid to the at least one liquid ejection section, wherein the at least one surface acoustic wave generation device generates the surface acoustic wave in an amplitude that is smaller than a threshold amplitude value required for jetting the liquid from the at least one liquid ejection section.

In one aspect, the at least one surface acoustic wave amplification device may amplify the surface acoustic wave generated while propagating through the surface acoustic wave propagation element to have an amplitude that is equal to or greater than the threshold amplitude value required for jetting liquid from the at least one liquid ejection section.

In another aspect, the least one surface acoustic wave generation device, the least one liquid ejection section and the least one surface acoustic wave amplification device may be arranged on a single line.

In still another aspect, the surface acoustic wave may propagate in the surface acoustic wave propagation element along the single line.

In another aspect, the at least one surface acoustic wave generation device may generate the surface acoustic wave when the liquid is not jetted from the at least one liquid ejection section.

In one aspect of the present embodiment, the step of driving the plurality of surface acoustic wave generation devices may be selectively stopped such that the ink is not jetted from selected ones of the plurality of ink ejection sections.

In one aspect of the present embodiment, one or both of two of the plurality of surface acoustic wave generation devices may not be excited such that the ink is not jetted from the one of the plurality of ink ejection sections.

In one aspect, the ink-jet recording apparatus in accordance with the present embodiment may further include a driving unit that performs a driving method including the steps of driving a plurality of surface acoustic wave generation devices, and generating with at least one of the plurality of surface acoustic wave generation devices a surface acoustic wave that reaches one of a plurality of ink ejection sections closest to the at least one of the surface acoustic wave generation devices in an amplitude smaller than a threshold amplitude value required for jetting ink from the one of the plurality of ink ejection sections.

In one aspect of the present embodiment, the plurality of surface acoustic wave generation devices may be driven such that, when two surface acoustic waves that are generated by two of the plurality of surface acoustic wave generation devices closest to the one of the plurality of ink ejection sections and propagate in opposite directions toward the one of the plurality of ink ejection sections overlap each other at a center of the one of the plurality of ink ejection sections, an amplitude of the surface acoustic waves overlapped is smaller than the threshold amplitude value required for jetting ink from the one of the plurality of ink ejection sections without regard to relative phases of the two surface acoustic waves.

In one aspect, at least two surface acoustic wave amplification devices may be located closest to the one of the plurality of ink ejection sections, and the surface acoustic wave generation devices and the surface acoustic wave amplification devices may be driven such that, when two surface acoustic waves that are generated by two of the surface acoustic wave generation devices closest to the one of the ink ejection sections and propagate in opposite directions toward the one of the plurality of ink ejection sections overlap each other at a center of the one of the plurality of ink ejection sections, an amplitude of the surface acoustic waves overlapped is greater than the threshold amplitude value required for jetting ink from the one of the plurality of ink ejection sections.

In one aspect, the surface acoustic wave generation devices and the surface acoustic wave amplification devices may be driven selectively such that the ink is jetted from selected ones of the plurality of ink ejection sections.

In another aspect, the surface acoustic wave generation devices may be driven selectively such that the ink is not jetted from selected ones of the plurality of ink ejection sections.

In another aspect, the step of driving the plurality of surface acoustic wave generation devices may be selectively stopped such that the ink is not jetted from selected ones of the plurality of ink ejection sections.

In one aspect, one or both of the two of the plurality of surface acoustic wave generation devices may not be excited such that the ink is not jetted from the one of the plurality of ink ejection sections.

In another aspect, the liquid ejection unit may include a plurality of liquid ejection sections for the surface acoustic wave generation unit that consists of a single surface acoustic wave generation device.

In still another aspect of the present embodiment, the liquid may include a resin having a stimulus reactivity to change properties thereof in response to a physical or chemical stimulus.

Other objects, features and advantages of the invention will become apparent from the following detailed description taken in conjunction with the accompanying drawings.

BRIEF DESCRIPTION OF THE DRAWINGS

FIG. 4(*b*) is a schematic diagram of an ink-jet head in accordance with the present invention.

DESCRIPTION OF THE PREFERRED EMBODIMENTS:

(First Embodiment)

Embodiments of the present invention will be described below with reference to the accompanying drawings.

Figure 1:
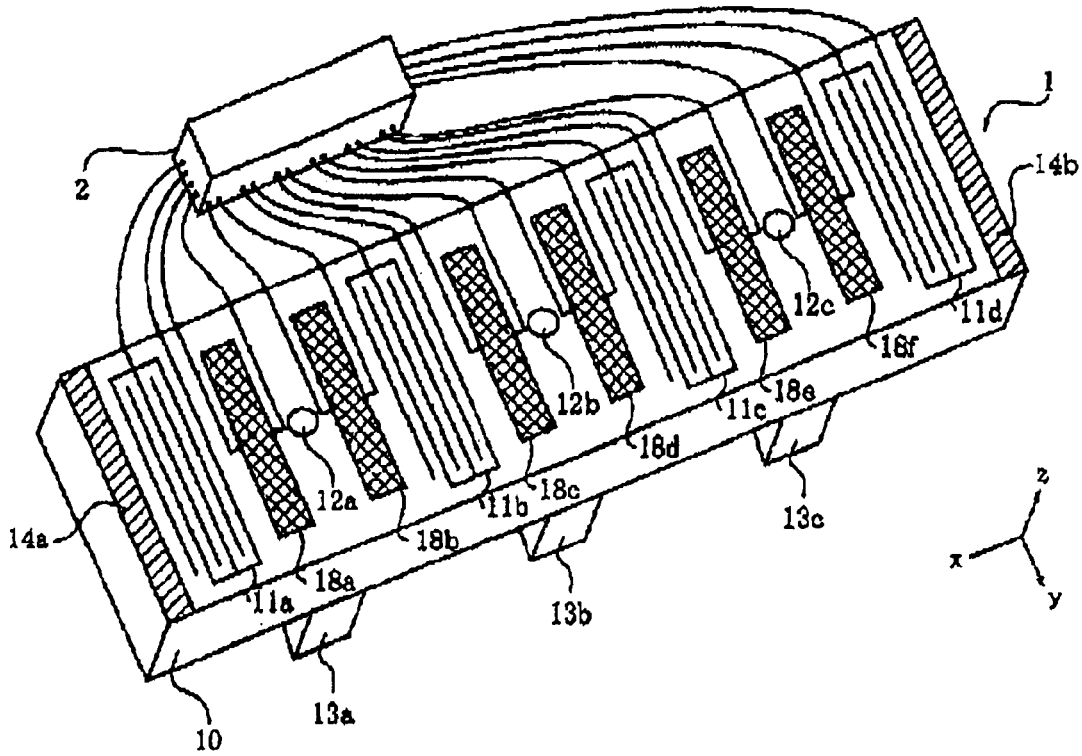
FIG. 1 is a perspective view of an ink-jet head in accordance with a first embodiment of the present invention.

FIG. 1 is a perspective view of an ink-jet head 1 in accordance with a first embodiment of the present invention. The ink-jet head 1 includes a driving device 2, a surface acoustic wave propagation element 10, a plurality of comb-shaped electrodes 11*a*, 11*b*, 11*c* and 11*d*, ink ejection sections 12*a*, 12*b* and 12*c*, ink reservoirs 13*a*, 13*b* and 13*c*, sound absorbing materials 14*a* and 14*b* that absorb unnecessary surface acoustic waves, and monolithic surface acoustic wave amplifiers 18*a*, 18*b*, 18*c*, 18*d*, 18*e* and 18*f*. Each of the monolithic surface acoustic wave amplifiers 18*a*–18*f* has a structure in which a semiconductor layer is vapor-deposited on the surface acoustic wave propagation element 10, and an electrode for carrier injection is stacked in layers on the semiconductor layer. The driving device 2 can control the comb-shaped electrodes 11*a*–11*d* and the monolithic surface acoustic wave amplifiers 18*a*–18*f* independently of one another. As indicated in FIG. 1, preferably, the ink ejection sections 12*a*–12*c* and the comb-shaped electrodes may be alternately disposed at equal intervals: and each of the surface acoustic wave amplifiers 18*a*–18*f* is disposed between adjacent ones of the ink ejection sections 12*a*–12*c* and the comb-shaped electrodes 11*a*–11*d*. Each of the ink ejection sections 12*a*–12*c* communicates with a corresponding one of the ink reservoirs 13*a*–13*c*, respectively. Although the ink ejection sections, the comb-shaped electrodes and the surface acoustic wave amplifiers are arranged at equal intervals in the present embodiment, they may be arranged at intervals that are not equal. The ink reservoirs may be independent of one another, or a part or all of them may be commonly shared by one another. In the present embodiment, the ink reservoirs are provided independently of one another. Ink that is contained in each of the ink reservoirs enters the corresponding ink ejection section by capillary phenomenon, thereby maintaining a state in which the ink ejection section is filled with the ink. The surface acoustic wave propagation element 10 may be made of a 128° Y-cut, X-propagation or Y-cut, Z-propagation $LiNbO_3$ or $LiTaO_3$, a piezoelectric single-crystal such as quartz, piezoelectric ceramics such as PZT, an element made of a glass plate and a piezoelectric film such as ZnO provided on the glass plate, or the like. InSb may preferably be used as the semiconductor for the surface acoustic wave amplifiers 18*a*–18*f*. More preferably, a protection film of SiO may be used such that, when $LiNbO_3$ is used as the surface acoustic wave propagation element 10, a structure of $LiNbO_3$—SiO—InSb—SiO may be formed. This structure can prevent deterioration of the InSb film and improves the characteristic thereof.

Figure 2:
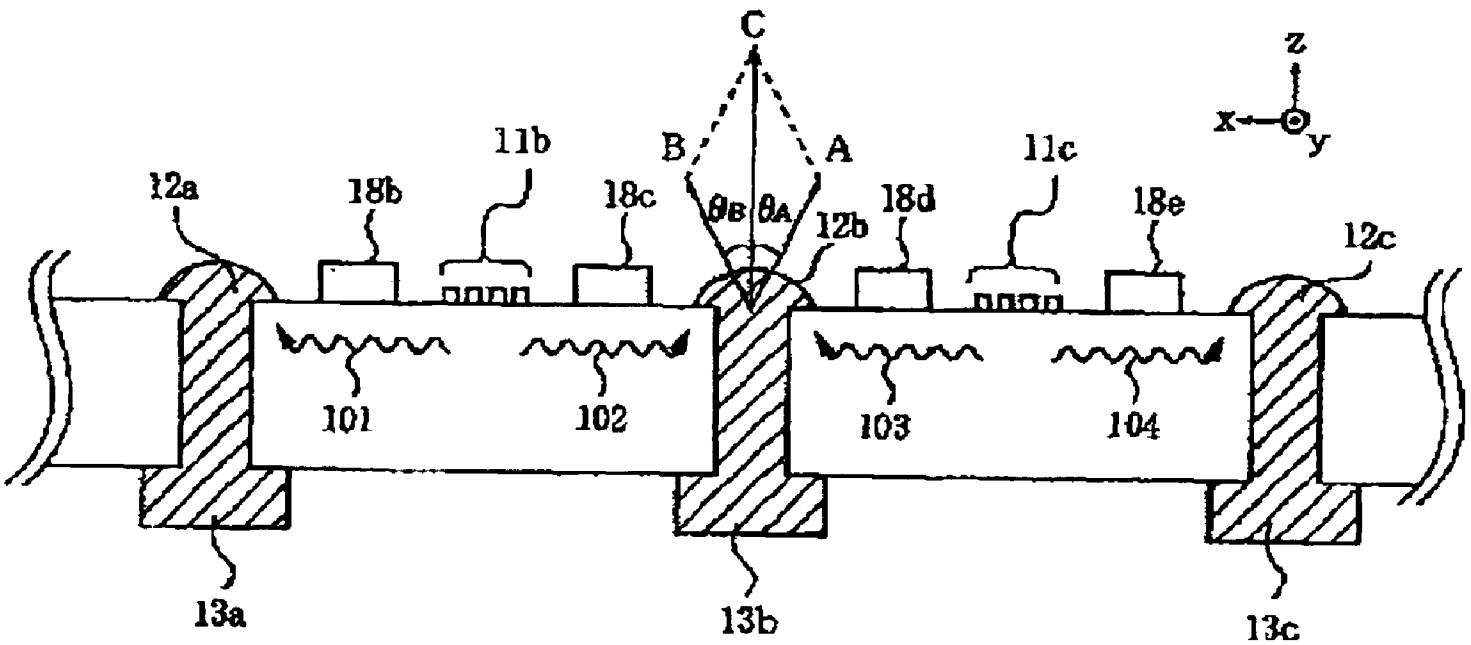
FIG. 2 is a cross-sectional view of the ink-jet head in accordance with the first embodiment of the present invention.
Figure 3:
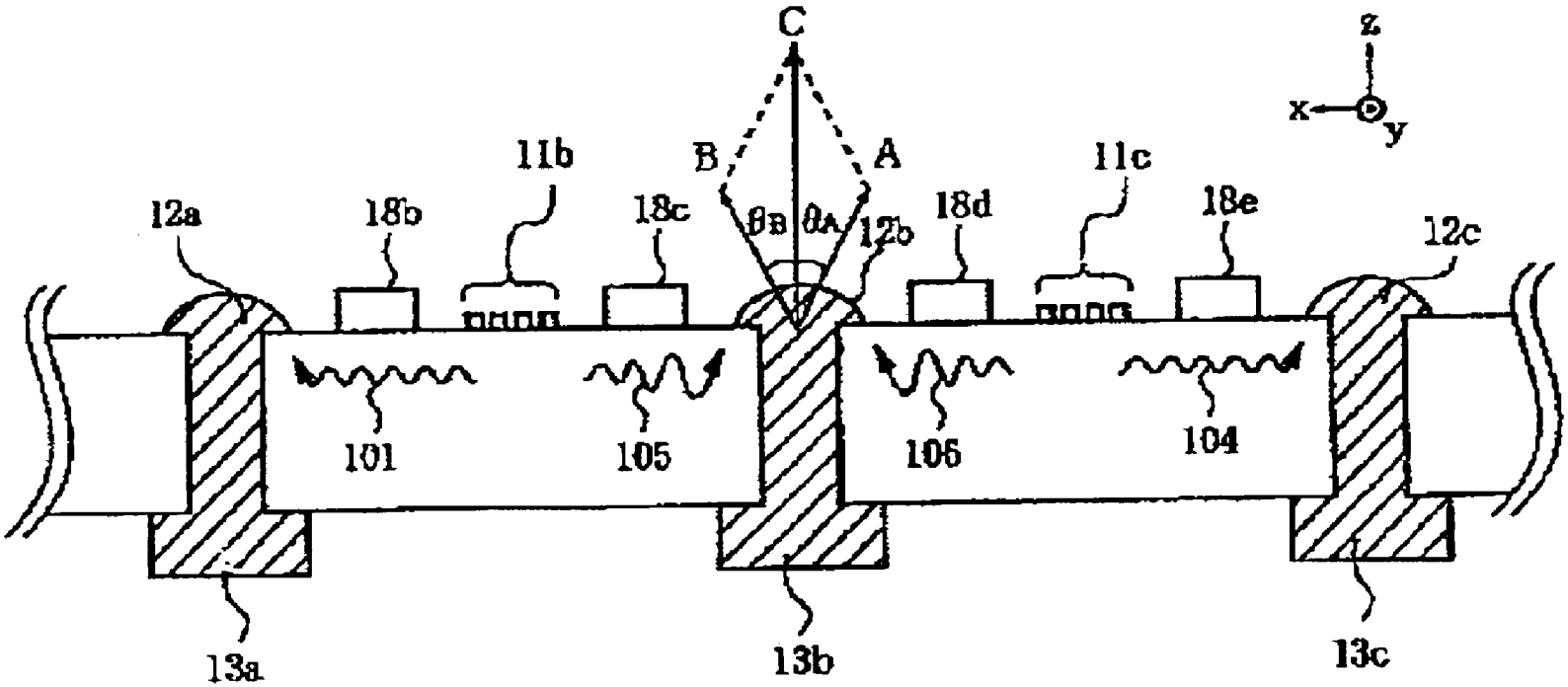
FIG. 3 is a cross-sectional view of the ink-jet head in accordance with the first embodiment of the present invention.

Next, a method for jetting ink from the ink-jet head 1 described above will be described with reference to FIGS. 2 and 3. FIGS. 2 and 3 are cross-sectional views of the ink-jet head 1 shown in FIG. 1. Components that are the same as those shown in FIG. 1 are assigned the same reference numbers, and their description is omitted. An electrical signal with an appropriate frequency is applied by the driving circuit 2 to the comb-shaped electrodes 11*b* and 11*c* such that the comb-shaped electrodes 11*b* and 11*c* are excited to generate surface acoustic waves. FIGS. 2 and 3 show a surface acoustic wave 101 that is generated by the comb-shaped electrode 11*b* and propagates in a positive (+) x direction, a surface acoustic wave 102 (or 105) that is generated by the comb-shaped electrode 11*b* and propagates in a negative (−) x direction, a surface acoustic wave 103 (or 106) that is generated by the comb-shaped electrode 11*c* and propagates in the positive (+) x direction, and a surface acoustic wave 104 that is generated by the comb-shaped electrode 11*c* and propagates in the negative (−) x direction.

First, one example in which ink is jetted from one of the ink ejection sections will be described, taking the ink ejection section 12*b* as an example. When the surface acoustic wave 102 reaches the ink ejection section 12*b*, the surface acoustic wave 102 discharges its vibration energy into the ink and rapidly attenuates. In contrast, the ink that gains the energy may fly out in a direction of a vector A in the figure. At this moment, if the amplitude of the surface acoustic wave 102 is sufficiently large, the ink would become fine particles and fly out into the air. Assuming that the vector A and a line perpendicular to the surface acoustic wave propagation element define an angle $\theta_A$, a velocity of the surface acoustic wave in the surface acoustic wave propagation element 10 is $v_{sol}$, and the sound velocity in the ink is $v_{liq}$, the angle $\theta_A$ is uniquely determined by the following expression:

$$\theta_A = \sin^{-1}\frac{v_{liq}}{v_{sol}}$$

For example, when 128° Y-cut, X-propagation $LiNbO_3$ is used as the surface acoustic wave propagation element 10, the propagation velocity of the Rayleigh wave is about 4000 m/sec; and when the sound velocity in the ink is assumed to be 1500 m/sec, the angle $\theta_A$ would be 22.02°. Let us consider general cases, and call the angle $\theta_A$ a streaming angle, which is expressed here by θ.

Figure 10:
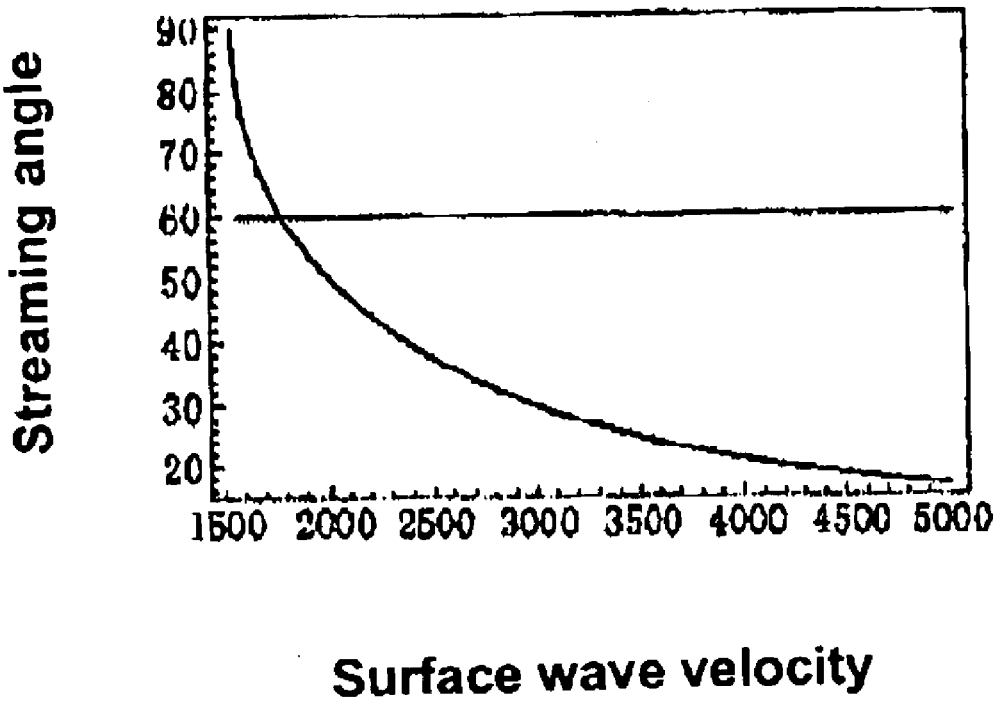
FIG. 10 is a graph that shows the basic principle of the present invention, and plots the streaming angle θ of the SAW streaming as a function of the velocity vs of a surface acoustic wave in a surface acoustic wave propagation element.

FIG. 10 shows a graph that plots the streaming angle θ as a function of the velocity vs of a surface acoustic wave in a surface acoustic wave propagation element. The sound velocity in the ink is assumed to be 1500 m/sec. As clearly indicated in the graph, the streaming angle becomes smaller as the velocity vs becomes greater. In materials that are generally used as the surface acoustic wave propagation element, the velocity vs of a surface acoustic wave is generally 3000 m/sec–4000 m/sec, and the streaming angle θ has values ranging between about 30° and 22.02°.

In accordance with the present embodiment, the amplitude of the surface acoustic wave 102 is controlled by the driving circuit 2 to be smaller than a threshold amplitude value that is required for the ink to be jetted in the form of liquid particles, and therefore the ink cannot be jetted solely by the surface acoustic wave 102. The ink also would fly out in a direction of a vector B indicated in the figure by the surface acoustic wave 103 that is generated by the comb-shaped electrode 11*c* disposed on the opposite side if the amplitude of the surface acoustic wave were sufficiently large. However, the amplitude of the surface acoustic wave 103 is also controlled like the surface acoustic wave 102 under the same principle described above, and therefore the vector A or the vector B alone does not exceed a required threshold value that is required for jetting the ink. Eventually, the surface acoustic waves 102 and 103 overlap each other at the ink ejection section 12*b*. As a result, the ink may fly out in a direction of a vector C that is the sum of the vector A and the vector B if the magnitude of the vector C were sufficiently large for ejecting the ink. The magnitude of the vector C depends on the phase relation between the two overlapping surface acoustic waves 102 and 103, and their respective amplitudes. Also, according to even a simple geometrical consideration, if the angle $\theta_A$ is equal to the angle $\theta_B$, and the phase condition is such that the two surface acoustic waves 102 and 103 are at maximum mutual intensification, the magnitude of the vector C would become greater than the magnitude of the vector A or the vector B, if angle $\theta_A=\theta_B<60°$. It is understood from FIG. 10 that, as long as any of the appropriate material described above is used, neither the angle $\theta_A$ nor the angle $\theta_B$ would exceed 60°, and therefore the magnitude of the vector C would become greater than that of the vector A or the vector B alone if the phases of the two surface acoustic waves 102 and 103 are appropriately controlled. However, in accordance with the present embodiment, as indicated in FIG. 2, even if the two surface acoustic waves 102 and 103 overlap each other in a phase relation for maximum mutual intensification, the amplitude of the overlapped waves is controlled to be smaller than a threshold amplitude value that is required for the ink to be jetted in the form of liquid particles. Accordingly, when only the comb-shaped electrodes, which are a surface acoustic wave generation means, are driven, the ink cannot be jetted.

However, when an appropriate electric field is applied to each of the monolithic surface acoustic wave amplifiers 18*c* and 18*d*, carriers are driven in the same direction of the respective surface acoustic waves (e.g., 102 and 103 in FIG. 2) such that the energy of the carriers is given to the respective surface acoustic waves, as indicated in FIG. 3. As a result, the two surface acoustic waves can be amplified into two surface acoustic waves 105 and 106. Consequently, the magnitude of each of the vector A and the vector B becomes greater compared to those in the case where the surface acoustic wave amplifiers are not driven as indicated in FIG. 2 and, as a result, the magnitude of the vector C that is the sum of the two vectors A and B becomes greater. Accordingly, by appropriately controlling the two monolithic surface acoustic wave amplifiers 18*c* and 18*d*, the amplitude of the overlapping waves of the amplified two surface acoustic waves 105 and 106 can be made greater than the threshold value for the ink to be jetted in the form of liquid particles. In the present embodiment, the two comb-shaped electrodes 11*b* and 11*c* are driven in a manner to control their phases such that the two generated surface acoustic waves overlap each other at the ink ejection section 12*b* in the same phase to thereby intensify each other, and the two monolithic surface acoustic wave amplifiers 18*c* and 18*d* are appropriately controlled to amplify the two surface acoustic waves like 105 and 106. As a result, the two amplified surface acoustic waves 105 and 106 overlap each other such that the ink can be jetted. Also, at this moment, the surface acoustic waves 101 and 104 that are simultaneously generated from the two comb-shaped electrodes affect the ink ejection sections 12*a* and 12*c*. However, because the amplitudes of these surface acoustic waves 101 and 104 are controlled in a manner described above, the ink would not be jetted from these ink ejection sections 12*a* and 12*c*. In the present embodiment, two comb-shaped electrodes on both sides of a target ink ejection section are excited such that two surface acoustic waves enter the target ink ejection section in a state in which their amplitudes and phases are controlled, and two monolithic surface acoustic wave amplifiers on both sides of the target ink ejection section are driven such that the amplitudes of the surface acoustic waves entering the target ink ejection section are appropriately amplified. As a result, ink is jetted from the target ink ejection section.

Next, a driving method for jetting ink simultaneously from two ink ejection sections will be described with reference to FIG. 1. When ink is jetted from two ink ejection sections simultaneously, the following three combinations are possible: a first combination of the ink ejection sections 12*a* and 12*b*, a second combination of the ink ejection sections 12*b* and 12*c*, and a third combination of the ink ejection sections 12*a* and 12*c*.

In the first combination in which ink is jetted simultaneously from the ink ejection sections 12*a* and 12*b*, a driving method similar to the driving method described above is used to excite the three comb-shaped electrodes 11*a*, 11*b* and 11*c* at the same time, and the monolithic surface acoustic wave amplifiers 18*a*, 18*b*, 18*c* and 18*d* are driven. In this instance, a surface acoustic wave that propagates from the comb-shaped electrode 11*a* in the positive x direction is absorbed by the sound absorbing material 14*a*; and therefore this particular surface acoustic wave does not interfere with or adversely affect other surface acoustic waves that are required to jet ink from any of the target ink ejection sections. In the present embodiment, as described above, sound absorbing material is used to absorb unnecessary surface acoustic waves to prevent the interference with other surface acoustic waves. However, alternatively, a one-directional comb-shaped electrode, which is a known technology, may be used as the comb-shaped electrode 11*a* at the end section. In such a case, the sound absorbing material 14*a* is unnecessary. In the present embodiment, the driving method controls such that a surface acoustic wave that propagates from the comb-shaped electrode 11*a* in the negative x direction and a surface acoustic wave that propagates from the comb-shaped electrode 11*b* in the positive x direction overlap each other in the same phase at the ink ejection section 12*a*, and that a surface acoustic wave that propagates from the comb-shaped electrode 11*b* in the negative x direction and a surface acoustic wave that propagates from the comb-shaped electrode 11*c* in the positive x direction overlap each other in the same phase at the ink ejection section 12*b*. Also, the amplitudes of these surface acoustic waves are controlled in a manner similar to the driving method described above, and therefore ink would not be jetted from the ink ejection section 12*c* by a surface acoustic wave that propagates from the comb-shaped electrode 11*c* in the negative x direction.

In the second combination in which ink is jetted simultaneously from the ink ejection sections 12*b* and 12*c*, a driving method similar to the driving method for the first combination described above is used to excite the three comb-shaped electrodes 11*b*, 11*c* and 11*d* at the same time, and the monolithic surface acoustic wave amplifiers 18*c*, 18*d*, 18*e* and 18*f* are driven. In this case, the amplitudes and phases are controlled in the same manner as in the first combination. Also, as described above in the first combination, a one-directional comb-shaped electrode may be used as the comb-shaped electrode 11*d* provided adjacent to the end section.

In the third combination in which ink is jetted simultaneously from the ink ejection sections 12*a* and 12*c*, a driving method similar to the driving method described above maybe used. To eject ink from the ink ejection section 12*a*, the comb-shaped electrodes 11*a* and 11*b* are excited, and the monolithic surface acoustic wave amplifiers 18*a* and 18*b* are driven. Further, to eject ink from the ink ejection section 12*c*, the comb-shaped electrodes 11*c* and 11*d* are excited, and the monolithic surface acoustic wave amplifiers 18*e* and 18*f* are driven. Let us also consider surface acoustic waves that are not required for jetting ink. The surface acoustic wave that propagates from the comb-shaped electrode 11*a* in the positive x direction is absorbed by the sound absorbing material 14*a*. Similarly, the surface acoustic wave that propagates from the comb-shaped electrode 11*d* in the negative x direction is also absorbed by the sound absorbing material 14*b*. Therefore, these surface acoustic waves do not adversely affect the ejection of ink from target ink ejection sections. It is noted, as described in the cases of the first combination and the second combination, that one-directional comb-shaped electrodes may be used as the comb-shaped electrodes 11*a* and 11*d* provided adjacent to the end sections.

A surface acoustic wave that propagates from the comb-shaped electrode 11*b* in the negative x direction and a surface acoustic wave that propagates from the comb-shaped electrode 11*c* in the positive x direction overlap each other at the ink ejection section 12*b*. However, in this case also, as described above, since the amplitudes of the two surface acoustic waves are controlled such that, even when the two surface acoustic waves overlap each other, an amplitude that causes ink to be jetted is not generated, the ink would not be jetted.

Lastly, a driving method in which ink is jetted simultaneously from three ink ejection sections will be described with reference to FIG. 1. Since ink is to be jetted from all of the ink ejection sections, all of the comb-shaped electrodes 11*a*, 11*b*, 11*c* and 11*d* are to be excited such that surface acoustic waves generated are to overlap in the same phase at all of the ink ejection sections, and all of the monolithic surface acoustic wave amplifiers 18*a*, 18*b*, 18*c*, 18*d*, 18*e* and 18*f* are to be driven at the same time.

Figure 4:
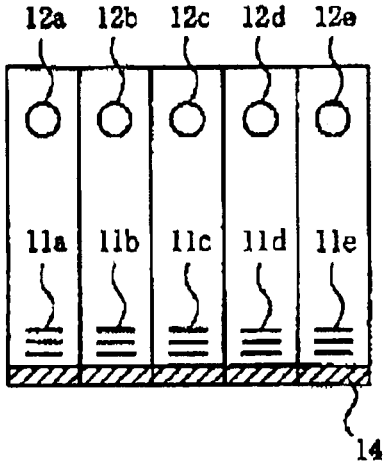
FIG. 4(*a*) is a schematic diagram of an ordinary multi-nozzle ink-jet head using surface acoustic waves, which is well known.
Figure 4:
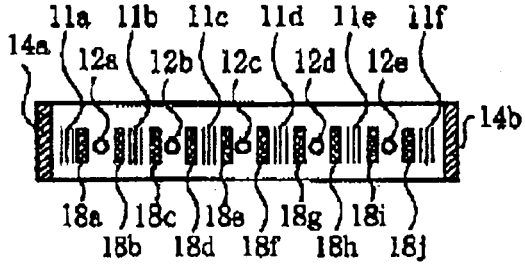

Next, the utility efficiency of energy required for jetting ink will be described with reference to FIGS. 4(*a*) and 4(*b*). FIG. 4(*a*) shows a conventionally known ink-jet head with a multi-nozzle structure that uses surface acoustic waves, and FIG. 4(*b*) shows an ink-jet head with a multi-nozzle structure that uses surface acoustic waves in accordance with an embodiment of the present invention.

In the conventional system indicated in FIG. 4(*a*), the ratio between the energy inputted and the energy used for jetting ink is always 0.5, no matter what the number N of the ink ejection sections is, or no matter what the number of ink ejection sections is to eject ink simultaneously. This is because one of surface acoustic waves generated in two directions is absorbed by sound absorbing material, and is not used for jetting ink. Here, the ratio between the energy inputted and the energy used for jetting ink is defined as the energy efficiency.

On the other hand, in the system of the present invention indicated in FIG. 4(*b*), the energy efficiency changes depending on the number of ink ejection sections, and the number of ink ejection sections that simultaneously eject ink. When the number N of ink ejection sections is designated, the energy efficiency would become lowest when ink is not jetted simultaneously from adjacent ones of the ink ejection sections. Examples of these situations include when ink is jetted from only one of the ink ejection sections, when two of the ink ejection sections are not adjacent to each other and ink is jetted simultaneously from the two ink ejection sections (for example, in the case when ink is jetted simultaneously from the ink ejection sections 12*a* and 12*c* in FIG. 1), or when ink is jetted from every other ink ejection section. In these cases, the energy efficiency would be 0.5, assuming that there is no energy loss in the monolithic surface acoustic wave amplifiers (the same assumption applies below). In other words, in the system of the present invention, the energy efficiency would not become lower than that of the conventional system even in the worst case. On the other hand, the energy efficiency becomes maximum when ink is simultaneously jetted from all of the ink ejection sections. The energy efficiency in this case is a function of the number N of the ink ejection sections. If the energy efficiency in this instance is defined as a maximum energy efficiency E, the maximum energy efficiency E is given by the following formula:

$$E = \frac{N}{N+1}.$$

Figure 5:
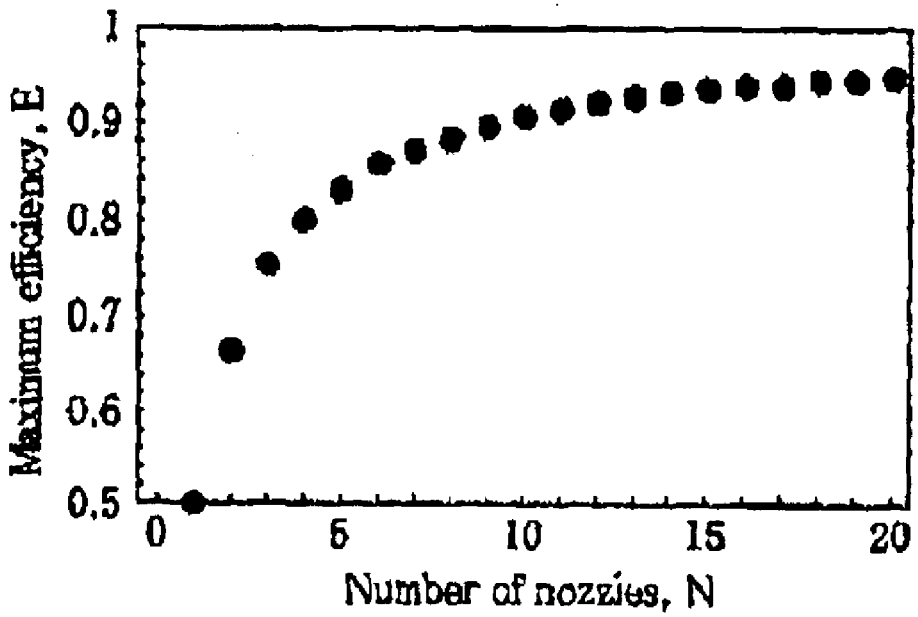
FIG. 5 is a graph that plots the maximum energy efficiency E of an ink-jet head in accordance with the present invention as functions of the number of nozzles N.

FIG. 5 is a graph that plots the maximum energy efficiency E as a function of the number of nozzles N. It is understood from the figure that the greater the number N of ink ejection sections, the more the maximum energy efficiency E successively approximates to 1. In other words, the system in accordance with the present invention proves that the energy efficiency doubles at maximum compared to the conventional system.

Figure 6:
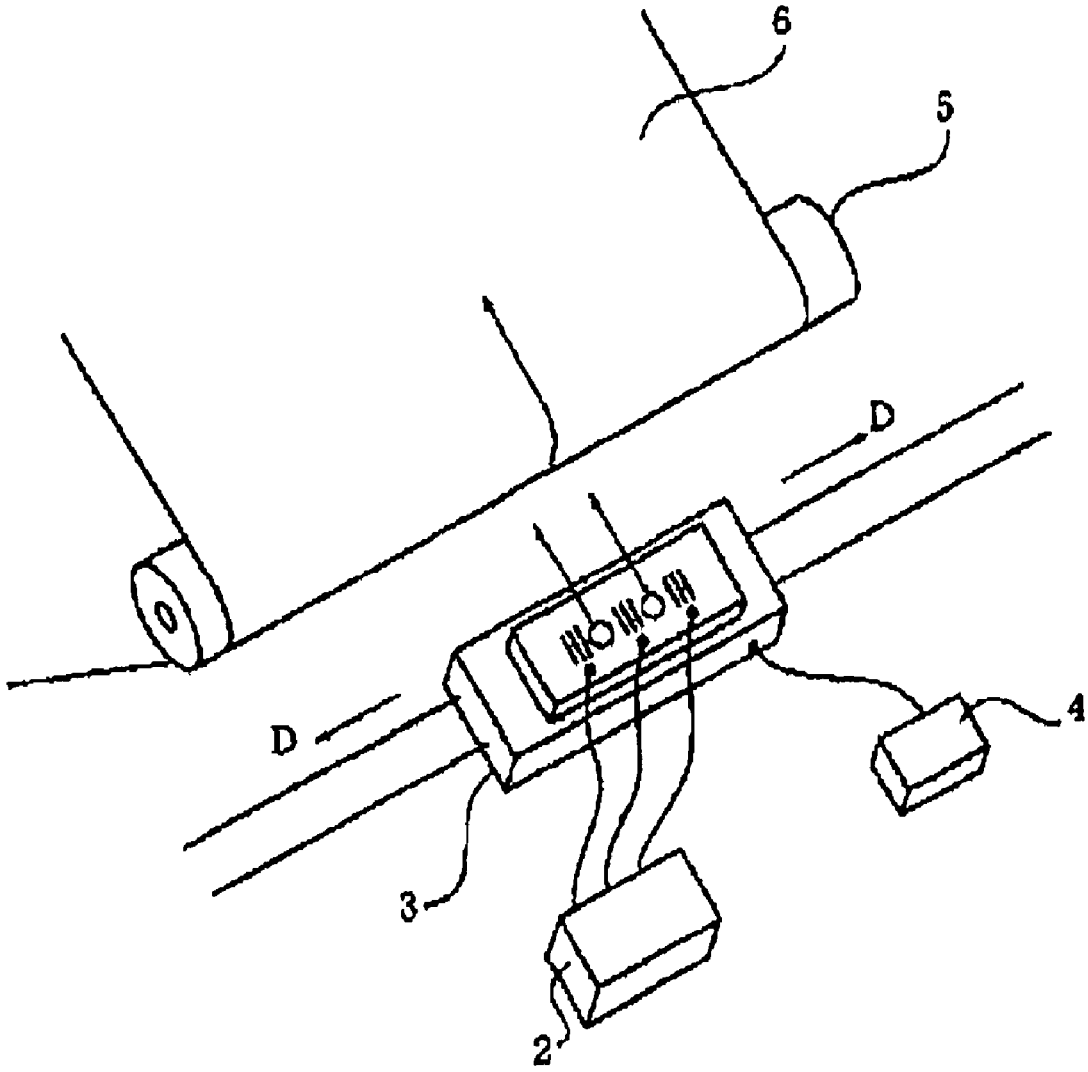
FIG. 6 is a schematic diagram of an ink-jet recording apparatus that uses the ink-jet head in accordance of the first embodiment shown in FIG. 1.

FIG. 6 schematically shows a basic structure of an ink-jet recording apparatus that uses an ink-jet head having the structure and the driving method described above. It is noted that the same components as those shown in FIG. 1 are indicated with the same reference numbers, and their description is omitted. The ink-jet recording apparatus is equipped with a print head 3 that is scanned in directions indicated by arrows D in the figure, a control device 2 that controls the position of the print head 3, and a roller 5. A recording paper 6 is set on the roller 5. While the print head 3 is scanned in the direction D, ink is jetted from the ink-jet head 1 on the print head 3, and fixed on the recording paper 6 that is fed by the roller 5 to record images, characters, patterns, etc. on the recording paper.

In the present embodiment, the print head is scanned in directions indicated by arrows D in the figure. However, the number of ink ejection sections may be increased to form an ink-jet head having a length generally the same as the width of the recording paper 6. By so doing, a recording range on the recording paper 6 can be covered without mechanically moving the print head while the print head is fixed at one place. Also, the number of ink ejection sections may be increased, and a plurality of colors such as yellow, magenta, cyan, black, etc. can be assigned to the ink ejection sections. This can realize a high quality color print head.

(Second Embodiment)

Figure 7:
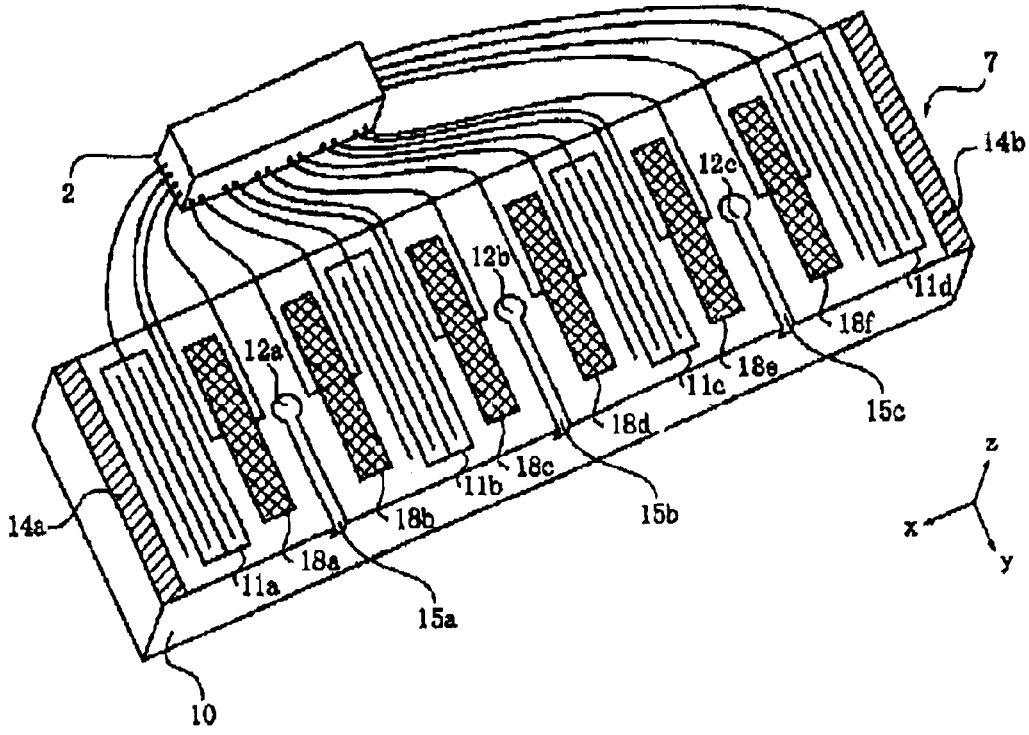
FIG. 7 is a perspective view of an ink-jet head in accordance with a second embodiment of the present invention.

FIG. 7 is a perspective view of an ink-jet head 7 in accordance with a second embodiment of the present invention. It is noted that components that are the same as those described above are assigned the same reference numbers, and their description is omitted.

In the second embodiment, the ink-jet head 7 includes a surface acoustic wave propagation element 10. Groove sections 15*a*–15*c*, which are ink supply means, are formed in the surface of the surface acoustic wave propagation element 10. Ink follows the groove sections and reaches ejection sections 12*a*–12*c*. The ink-jet head may include ink reservoirs (omitted from this figure). Other components and the driving method are generally the same as those of the first embodiment.

Also, by using the ink-jet head 7 of the second embodiment in the ink-jet recording apparatus of the first embodiment shown in FIG. 6 instead of the ink-jet head 1, images, characters, patterns, etc. can be recorded on a recording paper sheet just like the first embodiment.

(Third Embodiment)

Figure 8:
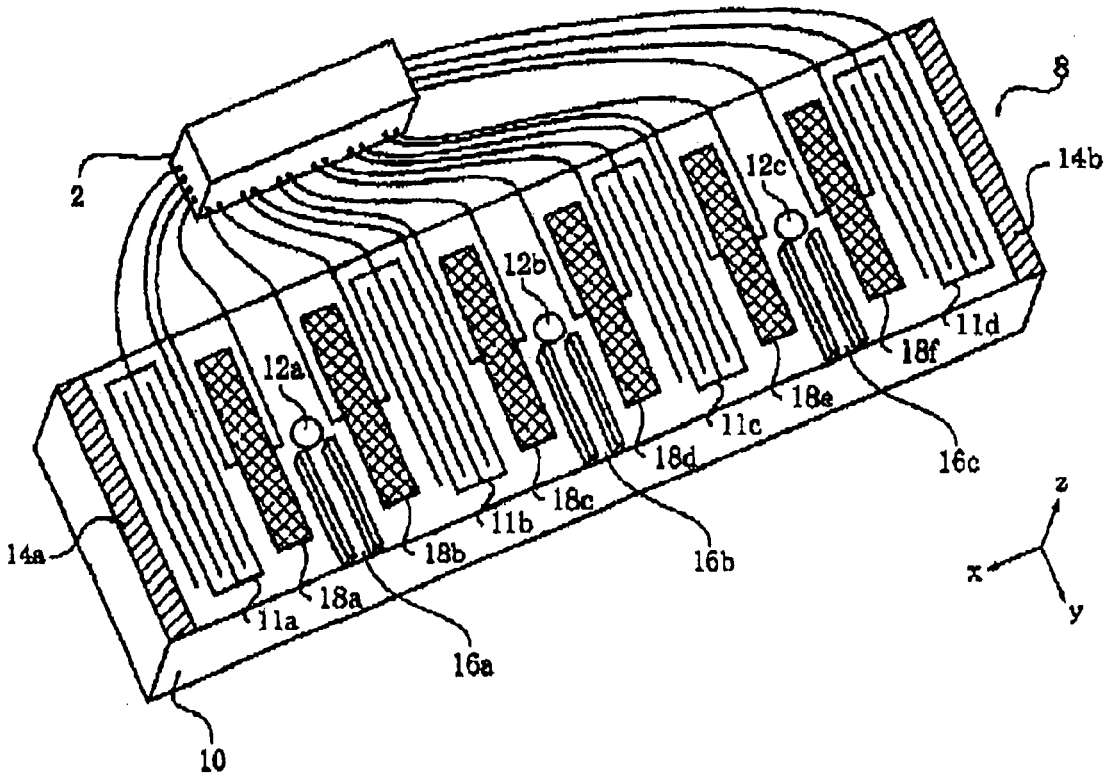
FIG. 8 is a perspective view of an ink-jet head in accordance with a third embodiment of the present invention.

FIG. 8 is a perspective view of an ink-jet head 8 in accordance with a third embodiment of the present invention. It is noted that components that are the same as those described above are assigned the same reference numbers, and their description is omitted.

In the present embodiment, guide members 16*a*–16*c*, which are ink supply means, are formed on the surface of a surface acoustic wave propagation element 10. Each of the guide members 16*a*–16*c* is composed of two elongated members, and ink passes through the guide members and reaches respective ejection sections 12*a*–12*c*. The ink-jet head may include ink reservoirs (omitted from this figure). Other components and the driving method are generally the same as those of the first embodiment.

Also, by using the ink-jet head 8 of the third embodiment in the ink-jet recording apparatus of the first embodiment shown in FIG. 6 instead of the ink-jet head 1, images, characters, patterns, etc. can be recorded on a recording paper sheet just like the first embodiment.

(Fourth Embodiment)

Figure 9:
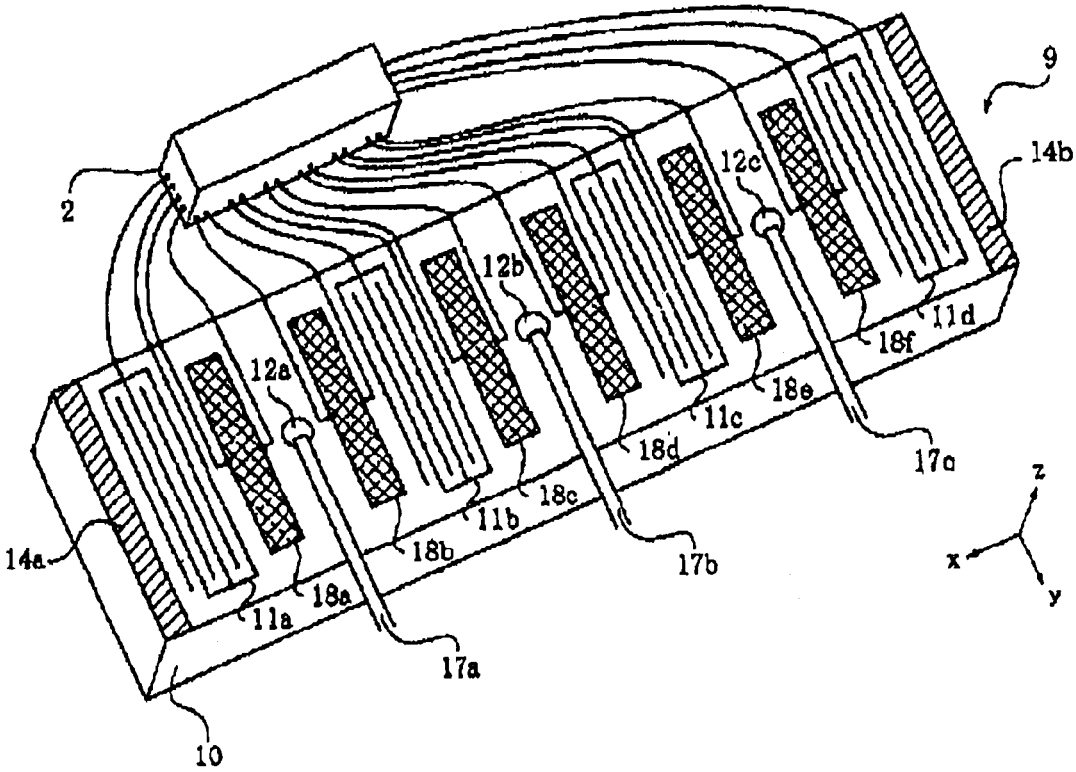
FIG. 9 is a perspective view of an ink-jet head in accordance with a fourth embodiment of the present invention.

FIG. 9 is a perspective view of an ink-jet head 9 in accordance with a fourth embodiment of the present invention. It is noted that components that are the same as those described above are assigned the same reference numbers, and their description is omitted.

In the present embodiment, tubes 17*a*–17*c*, which are ink supply means, are provided on a surface of a surface acoustic wave propagation element 10. Ink passes through these pipes and reaches respective ejection sections 12*a*–12*c*. The ink-jet head may include ink reservoirs (omitted from this figure). Other components and the driving method are generally the same as those of the first embodiment.

Also, by using the ink-jet head 9 of the fourth embodiment in the ink-jet recording apparatus of the first embodiment shown in FIG. 6 instead of the ink-jet head 1, images, characters, patterns, etc. can be recorded on a recording paper sheet just like the first embodiment.

As described above, in accordance with the embodiments of the present invention, recording operations can be conducted with a high energy efficiency.

(Fifth Embodiment)

Figure 11:
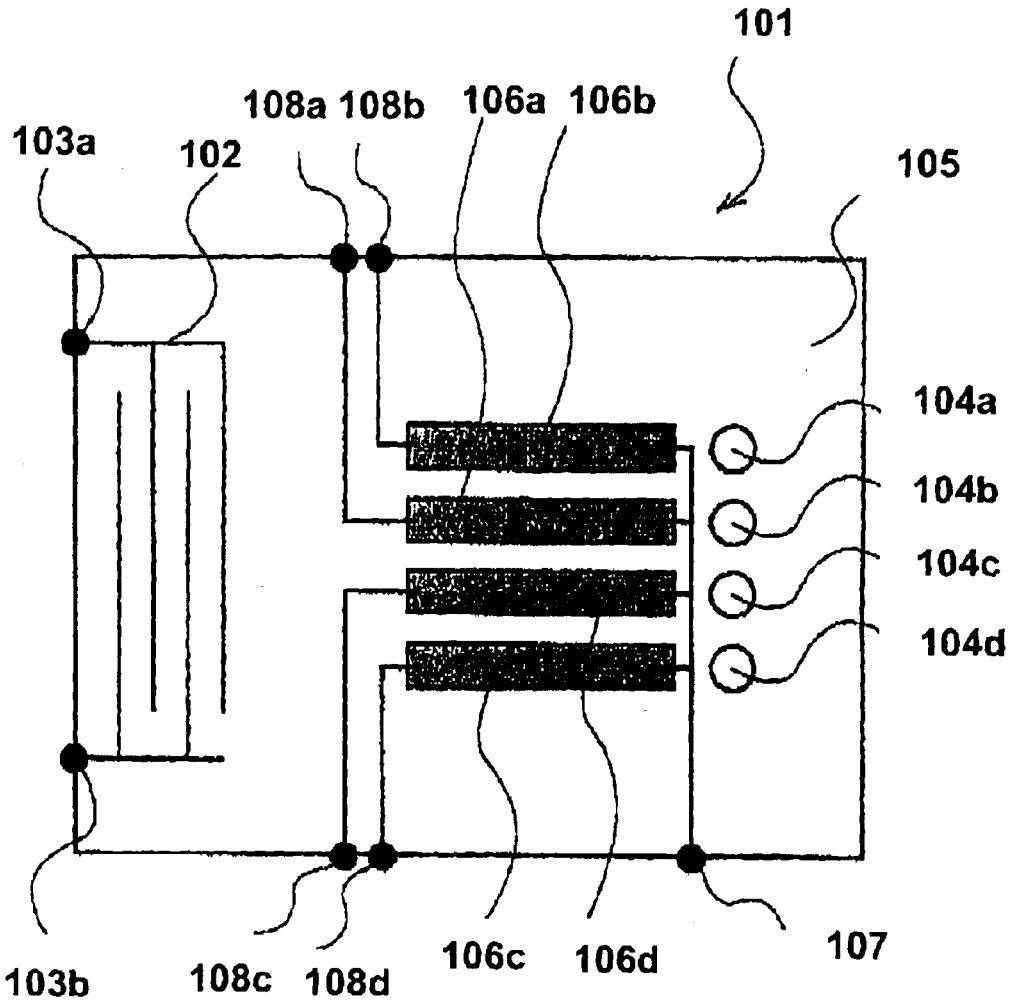
FIG. 11 is a plan view of a liquid ejection head in accordance with a fifth embodiment of the present invention.

FIG. 11 is a plan view of a liquid ejection head 101 in accordance with a fifth embodiment of the present invention. The liquid ejection head 101 is equipped with a comb-shaped electrode 102, which is a surface acoustic wave generation means, terminals 103*a* and 103*b* that are connected to a driving device 115 (not shown in FIG. 11 but shown in FIG. 14) for driving the comb-shaped electrode, liquid ejection sections 104*a*, 104*b*, 104*c* and 104*d*, a surface acoustic wave propagation element 105, monolithic semiconductor surface acoustic wave amplifiers 106*a*, 106*b*, 106*c* and 106*d* that are driven independently of one another, a common electrode 107 for the monolithic semiconductor surface acoustic wave amplifiers, and terminals 108*a*, 108*b*, 108*c* and 108*d* that are connected to a driving apparatus 116 (not shown in FIG. 11 but shown in FIG. 14) that drives the monolithic semiconductor surface acoustic wave amplifiers independently of one another. As indicated in the figure, the monolithic semiconductor surface acoustic wave amplifiers 106*a*–106*d* are disposed for the plurality of liquid ejection sections 104*a*–104*d*, respectively, such that monolithic semiconductor surface acoustic wave amplifiers 106*a*–106*d* can independently amplify surface acoustic waves propagating from the comb-shaped electrode 102 and conduct them toward the corresponding plurality of liquid ejection sections 104*a*–104*d*, respectively. It is noted that the plurality of liquid ejection sections 104*a*–104*d* are disposed at locations where the liquid ejection sections 104*a*–104*d* can receive the propagating surface acoustic waves without interfering with one another. In other words, intervals of the liquid ejection sections, and locations and distances of the liquid ejection sections with respect to the comb-shaped electrode are adjusted such that the liquid ejection sections 104*a*–104*d* can receive the propagating surface acoustic waves without interfering with one another.

In the present embodiment, the mutual interval among the plurality of ejection sections 104*a*–104*d*, the interval between the comb-shaped electrode 102 and each of the plural ejection sections 104*a*–104*d*, the mutual interval among the plurality of monolithic semiconductor surface acoustic wave amplifiers 106*a*–106*d*, the interval between the comb-shaped electrode 102 and each of the plurality of monolithic semiconductor surface acoustic wave amplifiers 106*a*–106*d*, and the interval between each of the plurality of liquid ejection sections 104*a*–104*d* and each of the corresponding plurality of monolithic semiconductor surface acoustic wave amplifiers 106*a*–106*d* are equal to one another, respectively. However, they may be located at irregular intervals. A fine hole that penetrates the surface acoustic wave propagation element 105 and reaches the rear surface thereof is provided at each of the liquid ejection sections 104*a* through 104*d*. A liquid reservoir 109 (not shown in FIG. 11, but shown in FIG. 12) having at least one liquid chamber is provided at the rear surface of the surface acoustic wave propagation element 105. Ink is guided from the liquid reservoir 109 to each of the liquid ejection sections 104*a* through 104*d* by capillary phenomenon. The surface acoustic wave propagation element 105 may be made of 128° Y-cut, X-propagation or Y-cut, Z-propagation $LiNbO_3$ or $LiTaO_3$, a piezoelectric single-crystal such as quartz, piezoelectric ceramics such as a PZT, an element made of a glass plate and a piezoelectric film such as ZnO provided on the glass plate, or the like.

Next, referring to FIGS. 12 and 13, the structure of the monolithic surface acoustic wave amplifiers 106*a*–106*d*, the operation principle of the liquid ejection head in accordance with the present embodiments, and in particular, the method for controlling ejection/non-ejection of liquid from a plurality of ejection sections will be described.

Figure 12:
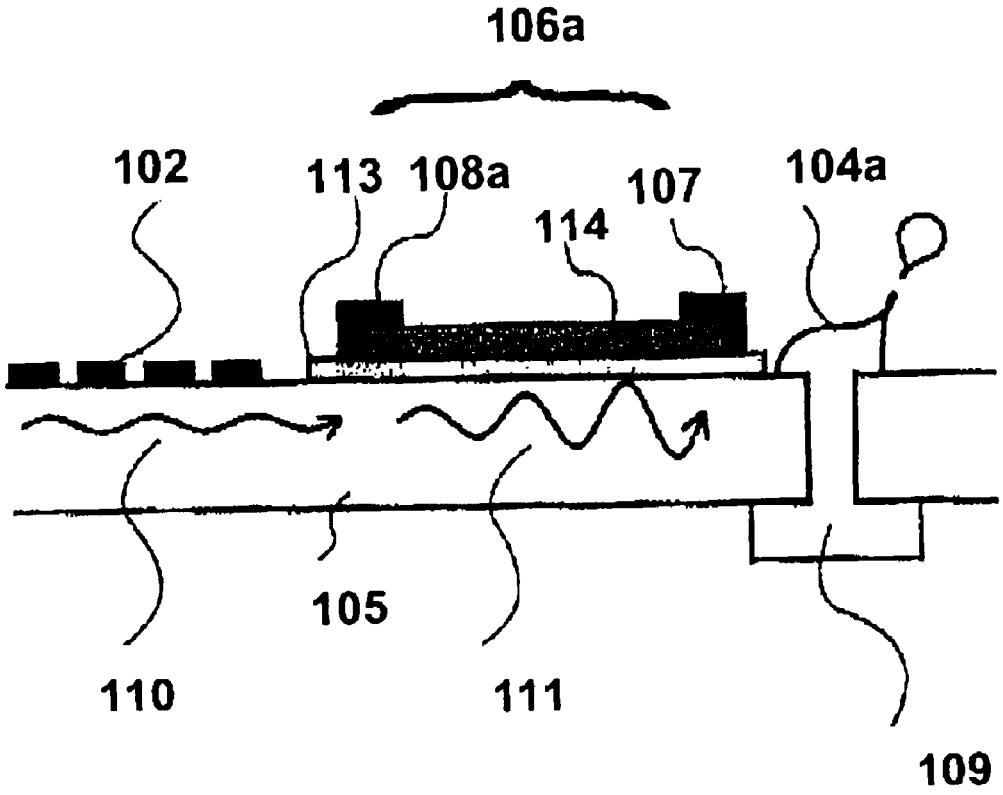
FIG. 12 is a cross-sectional view showing a cross-section that includes an ejection section 104*a* of FIG. 11.
Figure 13:
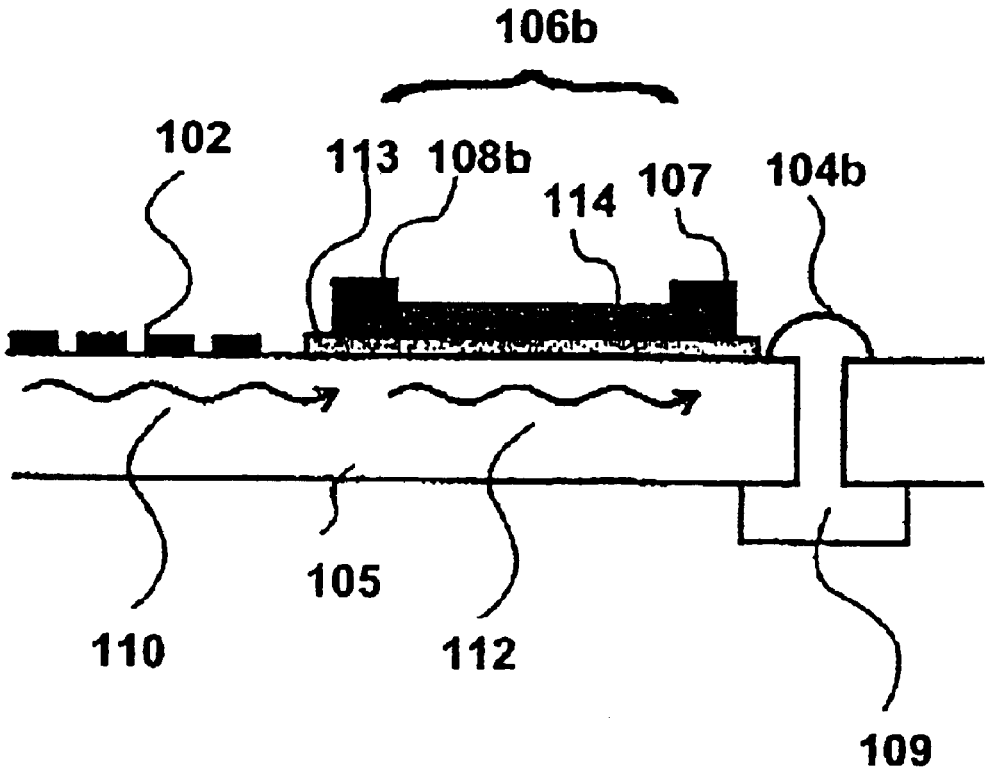
FIG. 13 is a cross-sectional view showing a cross-section that includes an ejection section 104*b* of FIG. 11.

FIGS. 12 and 13 schematically show cross-sectional views of the liquid ejection head shown in FIG. 11. Components that are the same as those shown in FIG. 11 are assigned the same reference numbers, and their description is omitted. A description will be made below as to a state in which liquid is jetted from the liquid ejection section 104*a* but liquid is not jetted from the liquid ejection section 104*b*. More specifically, FIG. 12 schematically shows a cross-sectional view of the liquid ejection head in which liquid is jetted from the liquid ejection section 104*a*, and FIG. 13 schematically shows a cross-sectional view of the liquid ejection head in which liquid is not jetted from the liquid ejection section 104*b*. Referring to FIGS. 12 and 13, reference numeral 109 denotes a liquid reservoir, reference numeral 110 denotes a surface acoustic wave that is excited by the comb-shaped electrode 102, reference numeral 111 is a surface acoustic wave that is amplified by the monolithic semiconductor surface acoustic wave amplifier 106*a*, reference numeral 112 denotes a surface acoustic wave that is not amplified by the monolithic semiconductor surface acoustic wave amplifier 106*b*, reference numeral 113 denotes a dielectric protection film, reference numeral 114 denotes a semiconductor thin film having a great mobility. As shown in the figures, each of the monolithic semiconductor surface acoustic wave amplifiers 106*a*–106*d* has a structure in which the dielectric film 113 is formed on the surface acoustic wave propagation element 105, and the semiconductor thin film 114 having a large carrier mobility and an electrode are stacked in layers on the dielectric thin film 113. In this embodiment, the dielectric protection film 113 may be made of a silicon nitride layer or a silicon oxide layer typically having a film thickness of about 300 angstrom to 500 angstrom, and the semiconductor thin film 114 may be made of an indium antimonide layer typically having a film thickness of about 500 angstrom. Furthermore, to prevent characteristic deterioration of the semiconductor thin film 114, a silicon nitride layer or silicon oxide layer may further be formed as a protection film on the surface of the semiconductor thin film 114 depending on the requirements. The process for forming these layers has already been well established in the semiconductor processing field. For example, a plurality of monolithic surface acoustic wave amplifiers can be readily manufactured and integrated, using a so-called photolithography technique, with high-accuracy at pitches of several tens $\mu$m to several hundreds $\mu$m. After the monolithic surface acoustic wave amplifiers and electrode patterns have been formed, appropriate techniques, such as, for example, the photolithography technique and a laser processing technique may be used again to form liquid ejection sections, which results in a plurality of high-accuracy, high-density liquid ejection sections at pitches of several tens $\mu$m to several hundreds $\mu$m.

The driving apparatus 116, which can drive the monolithic surface acoustic wave amplifiers independently of one another, is used to apply pulse electric fields to the monolithic surface acoustic wave amplifiers having the structure described above. As a result, carriers moving in the semiconductor thin film 114 and electric fields caused by the surface acoustic waves are combined, and the energy of the carriers is given to the surface acoustic waves if the velocity of the carriers is greater than the velocity of the surface acoustic waves, which causes an amplification action.

The comb-shaped electrode 102 is always burst-driven with a power level that is insufficient to cause ejection of liquid from any of the ejection sections 104*a* through 104*d*. Typically, the comb-shaped electrode 102 is driven to cause an excitation frequency of several tens kHz to several tens MHz in a repeating frequency of several kHz to several tens kHz. These values may differ depending on desired liquid ejection characteristics, in particular, values of physical properties of liquid jetted, liquid particle sizes and amount of liquid jetted, ejection timing, and the like. For example, the monolithic surface acoustic wave amplifier 106*a* corresponding to an ejection section from which liquid is to be jetted, which is the ejection section 104*a* in this embodiment example, is driven in a manner described above to amplify the incident surface acoustic wave 110 to become the incident surface acoustic wave 111 that exceeds a threshold amplitude of the surface acoustic wave that is required to eject liquid from the ejection section 104*a*. As a result, the liquid is jetted from the ejection section 104*a*. On the other hand, the monolithic surface acoustic wave amplifier 106*b* corresponding to an ejection section from which liquid is not to be jetted, which is the ejection section 104*b* in this embodiment example, is not driven such that liquid is not jetted from the ejection section 104*b*. By driving the liquid ejection head in a manner described above, ejection/non-ejection of liquid from a plurality of ejection sections can be controlled.

Also, as described above, the comb-shaped electrode 102 is always driven within a power range that does not cause ejection of liquid from any of the plurality of ejection sections. As a result, liquid at the ejection sections is always vibrated as it receives the effect of the surface acoustic waves, which can prevent deterioration of the ejection characteristics that may be caused by drying of the liquid at the ejection sections, and therefore can stabilize the initial ejection characteristic.

Moreover, since the comb-shaped electrode 102 does not need to be always driven by a power that is sufficient to cause ejection of liquid from the ejection sections, an improved energy efficiency can be expected.

A liquid ejection apparatus may be composed with the liquid ejection head 101 in accordance with the fifth embodiment of the present invention described above, a driving device 115 that applies driving signals to the comb-shaped electrode, and a driving device 116 that applies driving signals to a plurality of monolithic surface acoustic wave amplifiers, respectively. An example in which the aforementioned liquid ejection apparatus is applied to an ink-jet recording apparatus will be described below.

Figure 14:
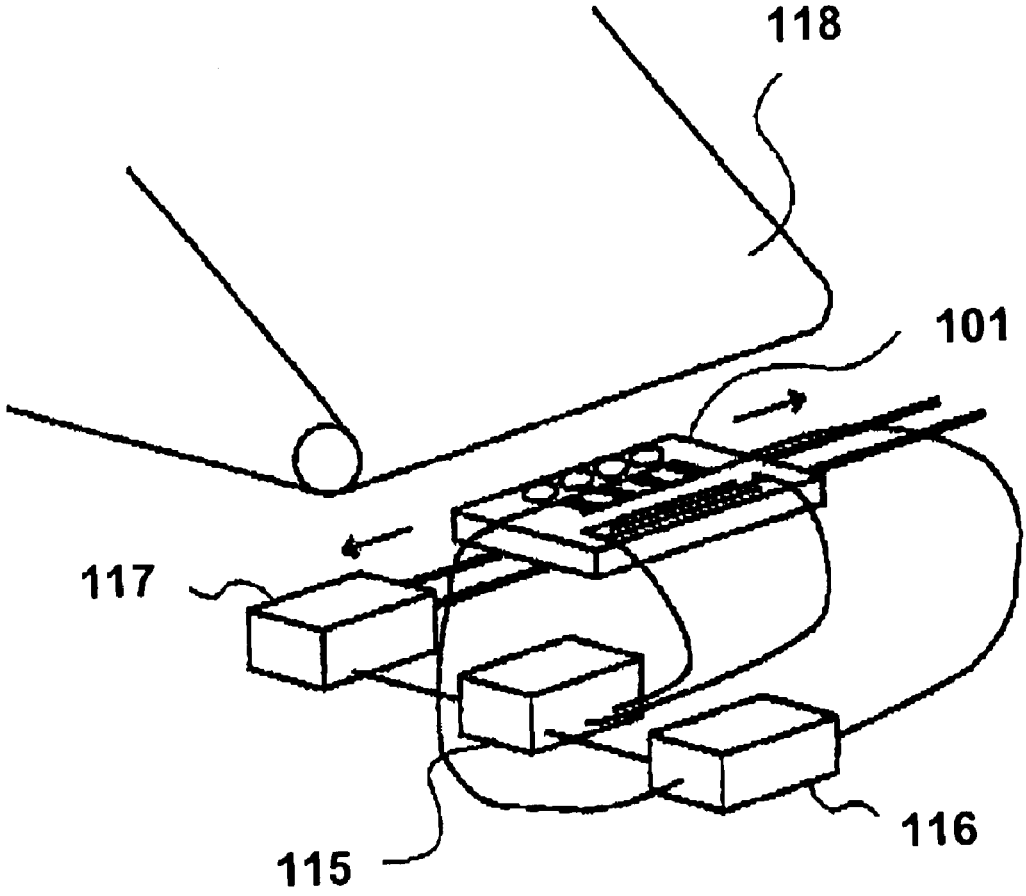
FIG. 14 is a schematic diagram of an ink-jet apparatus that uses a liquid ejection apparatus in accordance with the fifth embodiment of the present invention.

FIG. 14 shows an ink-jet recording apparatus that uses the liquid ejection apparatus described above, which uses four different ink-jet inks, i.e., cyan, magenta, yellow, and black (CMYK), as the liquid described above. These inks may be selected from inks that can be used for ink-jet recording, containing coloring agents such as dyes or pigments dissolved or dispersed in solvent (including water, for example). It is noted that components shown in FIG. 14 that are the same s those described above in FIGS. 11 through 13 are assigned the same reference numbers, and their description is omitted. Reference numeral 115 denotes a driving device that applies driving signals to the comb-shaped electrode, reference numeral 116 denotes a driving device that applies driving signals to a plurality of monolithic surface acoustic wave amplifiers independently of one another, respectively, reference numeral 117 denotes a device that scans the liquid ejection head, and reference numeral 118 denotes a recording paper sheet. The driving device 115, which applies driving signals to the comb-shaped electrode, is controlled to always burst-drive the comb-shaped electrode as described above, such that drying of ink at the ink ejection sections can be prevented. The driving device 116 is equipped with a system that receives output information from a work station, a personal computer or the like, and applies appropriate driving signals to the plurality of monolithic surface acoustic wave amplifiers as described above. The driving device 116 is operationally interlocked with the device 117 that scans the liquid ejection head, thereby recording on the recording paper sheet 118. The arrangement direction and the number of the ejection sections may be appropriately set such that the ink-jet recording section can be applied to a variety of ink-jet recording apparatuses ranging from a serial-type ink-jet recording apparatus like the one illustrated in FIG. 14 to a line-type ink-jet recording apparatus.

(Sixth Embodiment)

Next, in accordance with a sixth embodiment of the present invention, a liquid ejection device in accordance with the first embodiment of the present invention is applied to medicine spray inhalator devices. When the liquid ejection device in accordance with the first embodiment of the present invention is applied to a medicine spray inhalator device, medicine (liquid), such as, for example, insulin, nicotine, an anesthetic and the like as effective ingredients, is used as the liquid described above. Furthermore, the driving signal to be applied to the comb-shaped electrode and the shape of each ejection section may be appropriately determined to control ejection particles of medicine to have an appropriate particle size depending on medicine to be used. Also, the liquid reservoir may be formed as a removable medicine cartridge.

(Seventh Embodiment)

In accordance with a seventh embodiment of the present invention, the liquid ejection apparatus in accordance with the first embodiment may be applied to an apparatus that forms two-dimensional or three-dimensional objects. When the liquid ejection apparatus in accordance with the first embodiment is applied to a two-dimensional or three-dimensional object forming apparatus, resin having a photosensitivity to ultraviolet rays or visible rays, or liquid including resin that is responsive to a physical and/or chemical stimulus may be used as the liquid described above. In this case, the driving signal to be applied to the comb-shaped electrode and the shape of each ejection section may be appropriately determined to control ejection particles of resin to have an optimum ejection characteristic for resins to be used. Also, the present embodiment can readily realize a structure in which the resin and a hardening agent may be jetted from a plurality of ejection outlets, or the resin and coloring agents in a plurality of different colors may be jetted from a plurality of ejection outlets, depending on the requirements.

In view of the above, by utilizing any of the liquid ejection heads and methods for driving liquid ejection heads in accordance with the embodiments of the present invention, liquid ejection heads and liquid ejection apparatuses that can restrict lowering of the energy efficiency and can be integrated in high-density can be obtained.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An ink-jet head that jets ink by applying energy of surface acoustic waves to the ink for recording on a recording medium, the ink-jet head comprising:

a surface acoustic wave propagation element that propagates surface acoustic waves;

a plurality of surface acoustic wave generation devices disposed on the surface acoustic wave propagation element;

a plurality of ink ejection sections that are disposed in the surface acoustic wave propagation element and disposed alternately with the plurality of surface acoustic wave generation devices along a single line;

a plurality of surface acoustic wave amplification devices located between the surface acoustic wave generation devices and the ink ejection sections on the single line; and an ink supply unit that supplies ink to the ink ejection sections, wherein the plurality of surface acoustic wave generation devices are disposed such that all induced surface acoustic waves propagate along the single line.

2. An ink-jet head according to claim 1, wherein each of the plurality of surface acoustic wave generation devices comprises a comb-shaped electrode that is driven by application of a voltage.

3. An ink-jet head according to claim 2, wherein one of a plurality of the comb-shaped electrodes is disposed corresponding to each of the surface acoustic wave generation devices, and at least one of the comb-shaped electrodes is a one-directional comb-shaped electrode.

4. An ink-jet head according to claim 1, further comprising a sound absorbing material for absorbing surface acoustic waves that are unnecessary for jetting the ink, the sound absorbing material being provided on the surface acoustic wave propagation element.

5. An ink-jet head according to claim 1, wherein the ink supply unit includes a supply path that supplies the ink to each of the ink ejection sections.

6. An ink-jet head according to claim 5, wherein the supply path includes a groove formed in the surface acoustic wave propagation element.

7. An ink-jet head according to claim 5, wherein the supply path is a guide member formed on a surface of the surface acoustic wave propagation element.

8. An ink-jet head according to claim 5, wherein the supply path is a pipe disposed on a surface of the surface acoustic wave propagation element.

9. An ink-jet head according to claim 1, wherein the ink supply unit includes a plurality of ink supply sections, each of the ink supply sections comprising an ink reservoir provided on a surface of the surface acoustic wave propagation element for storing ink, and a through-hole portion that penetrates the surface acoustic wave propagation element and connects each ink reservoir with a corresponding one of the corresponding respective ink ejection sections.

10. An ink-jet head according to claim 1, wherein each of the surface acoustic wave amplification devices comprises a semiconductor layer vapor-deposited on a surface of the surface acoustic wave propagation element and a monolithic surface acoustic wave amplifier equipped with a component that injects carriers in the semiconductor layer.

* * * * *